United States Patent [19]

Malik

[11] Patent Number: 4,606,850

[45] Date of Patent: Aug. 19, 1986

[54] HARD SURFACE CLEANING COMPOSITION AND CLEANING METHOD USING SAME

[75] Inventor: Arshad H. Malik, Decatur, Ill.

[73] Assignee: A. E. Staley Manufacturing Company, Decatur, Ill.

[21] Appl. No.: 706,561

[22] Filed: Feb. 28, 1985

[51] Int. Cl.[4] ..... C11D 1/835; C11D 3/075

[52] U.S. Cl. ..... 252/528; 252/174.16; 252/174.17; 252/174.24; 252/547; 252/DIG. 14

[58] Field of Search ..... 252/547, 528, 174.17, 252/DIG. 14, 174.24, 174.16

[56] References Cited

U.S. PATENT DOCUMENTS

| | | | |
|---|---|---|---|
| 4,065,409 | 12/1977 | Flanagan | 252/528 |
| 4,158,644 | 6/1979 | Hammerel | 252/547 |
| 4,174,304 | 11/1979 | Flanagan | 252/524 |
| 4,203,872 | 5/1980 | Flanagan | 252/542 |
| 4,446,042 | 5/1984 | Leslie | 252/102 |

*Primary Examiner*—Prince E. Willis

*Attorney, Agent, or Firm*—James B. Guffey; Michael F. Campbell

[57] ABSTRACT

Novel liquid hard surface cleaning compositions are provided in the form of a homogeneous aqueous solution which comprises a glycoside surfactant, an amine oxide surfactant, a quaternary ammonium halide surfactant, a water soluble detergent builder and water and which effectively cleans soiled hard surfaces without rinsing.

Particularly preferred compositions of the present invention employ the amine oxide surfactant in a weight ratio of from about 0.5:1 to about 0.8:1 relative to the glycoside surfactant and utilize the quaternary ammonium halide surfactant in a weight ratio of from about 0.1:1 to about 0.4:1 relative to said glycoside surfactant.

20 Claims, No Drawings

HARD SURFACE CLEANING COMPOSITION AND CLEANING METHOD USING SAME

BACKGROUND OF THE INVENTION

The present invention relates to aqueous liquid detergent compositions and to the use of same for the cleansing of soiled hard surfaces such as appliance cabinets or housings, walls, windows and the like.

Alkyl glycoside materials such as, for example, higher alkyl monoglycosides and higher alkyl polyglycosides are known materials; are known, at least in certain circumstances, to function as nonionic surfactants; and have been suggested as being suitable for use in certain specially formulated detergent compositions. See in this regard, for example, Published European Patent Application Nos. 0070074; 0070075; 0070076; and 0070077, all of which published on Jan. 19, 1983 as well as Published European Patent Application Nos. 0075994; 0075995; and 0075996 which published on Apr. 6, 1983. See also Published European Patent Application No. 0105556 (published Apr. 18, 1984) which discloses liquid detergent compositions containing anionic surfactants, alkypolyglycoside surfactants, selected nonionic surfactants and optionally also containing various other ingredients such as suds stabilizing amine oxide surfactants, detergent builder materials, and the like; Published European Patent Application No. 0106692 (published Apr. 25, 1984) which discloses stable heavy-duty liquid detergent compositions containing a mixture of an ethoxylated fatty alcohol nonionic surfactant, an alkylpolyglycoside surfactant and a quaternary ammonium cationic surfactant in conjunction with a polyethylene glycol compound and a wide variety of potential conventional laundry detergent additives; and U.S. Pat. No. 4,493,773 (issued Jan. 15, 1985) which discloses laundry detergent compositions which contain a conventional nonionic detergent surfactant, an alkylpolyglycoside detergent surfactant and a quaternary ammonium cationic fabric softening surfactant and which are said to be capable of including a wide variety of conventional laundry detergent additives such as relatively small amounts of detergent builders, detergency cosurfactants such as trialkyl amine oxides, solvents such as ethanol, and the like.

A relatively specialized category of cleaning composition of interest to the art is one which is often referred to as a liquid detergent hard surface cleaning composition and which is specifically designed or formulated such that it can be applied to a soiled hard surface of interest (e.g., glass, painted walls, woodwork, etc.) and removed therefrom (for example as by wiping with a dry or damp cloth) without a subsequent rinsing operation and without leaving a significant residual film upon the surface after cleaning. Thus, for example, in Published South African Patent Application No. 666,781 there is described a hard surface cleaner composition which comprises from 1–10% of an anionic surfactant (e.g., alkyl sulfate or alkyl aryl sulphonate) or a nonionic surfactant (e.g., an ethylene oxide condensate of a fatty alcohol or of an alkyl phenol) and at least 20% of a 1:1 to 4:1 ratio mixture of an alkali metal (or ammonium) borate and sodium carbonate and which, at a 1% concentration in water, has a pH of at least 9.6.

On the other hand, U.S. Pat. No. 3,591,510 to William Edward Zenk (issued July 6, 1971) describes certain liquid hard surface cleaning compositions consisting essentially of from about 0.25 to 4% of certain selected anionic or zwitterionic detergents; from about 0.5 to about 6% of certain water soluble builder components; from about 1 to about 10% of certain selected organic solvents or solvent mixtures; and the balance being water.

In a recent journal article, namely "A Greasy Soil Hard Surface Cleaning Test" by Morris A. Johnson, *JAOCS*, Vol. 61, No. 4, pages 810–813 (April 1984), a series of commercially available solvent-based and water-based cleaners were tested for greasy soil removal effectiveness at various dilution ratios.

Hard surface cleaning formulations are also discussed in "Formulation of Hard Surface Spray Cleaners" by R. E. Johnson and E. T. Clayton, *detergents and specialties*, June 1969, pages 28–32 and 56. Formulations discussed in such article included (a) one which was composed of 1 weight percent of a nonionic surfactant (linear alcohol ethoxylate), 2.5 weight percent of anhydrous tetrapotassium pyrophosphate (builder), 5 weight percent of ethylene glycol monobutyl ether (solvent) and the balance water and (b) another which was the same as the former except that the indicated nonionic surfactant was replaced with a corresponding amount of a linear alkylbenzenesulfonate anionic surfactant. In said article, it is noted that the aforementioned nonionic surfactant-based formulation exhibited slightly more filming (i.e., being given a "moderate" film rating) than its corresponding anionic surfactant-based counter-part (which obtained a "moderate-good" film rating).

In U.S. Pat. No. 4,065,409 to John J. Flanagan (issued Dec. 27, 1977), there are disclosed certain liquid detergent compositions which comprise aqueous solutions containing certain selected ethoxylated nonionic surfactants in combination with certain amine oxide and quaternary ammonium halide surfactant components. Such compositions are described as being useful as hard surface detergents for cleaning surfaces such as painted wood, plaster or wall board; tile; glass; metal; linoleum and the like. The combination of the three surfactant ingredients indicated above is said to exhibit improved detergent properties relative to those exhibited by compositions containing any one or two of said ingredients at equivalent concentrations.

In U.S. Pat. No. 4,174,304 to John J. Flanagan (issued Nov. 13, 1979), surfactant systems comprising, in certain specified proportions, a combination of certain ethoxylated nonionic, amine oxide and quaternary ammonium halide surfactant components are described as being suitable, in combination with certain other specified ingredients (such as antifoaming agents, water softening agents, viscosity reducing agents, builders and the like) in the preparation of a wide variety of commercially useful cleaning formulations such as, for example, degreasing cleaner compositions; wax and floor finish stripper compositions; glass and smooth surface cleaning and polishing compositions; and the like.

SUMMARY OF THE INVENTION

It has now been discovered that the use of a glycoside surfactant in conjunction with an amine oxide surfactant, a quaternary ammonium halide surfactant and a water soluble detergent builder provides aqueous liquid detergent compositions which are particularly well suited for use in hard surface cleaning applications. Accordingly, the present invention is, in one of its aspects, a liquid detergent composition which comprises, on a total weight basis:

a. from about 0.05 to about 50 weight percent of a glycoside surfactant;

b. from about 0.025 to about 50 weight percent of an amine oxide surfactant, said amine oxide surfactant being employed in an amount corresponding to at least about 0.5 part thereof by weight per part by weight of said glycoside surfactant;

c. from about 0.005 to about 25 weight percent of a quaternary ammonium halide surfactant, said quaternary ammonium halide surfactant being employed in an amount corresponding to less than about 0.5 part thereof by weight per part by weight of said glycoside surfactant;

d. from about 0.1 to about 50 weight percent of a water soluble detergent builder; and e. from about 10 to about 99.8 weight percent water.

The compositions of the present invention generally provide enhanced foaming capability and greater foam stability than is normally provided by conventional nonionic surfactant compositions.

The aforementioned detergent composition can, if desired, suitably take the form of a dilutable liquid concentrate in order to facilitate the convenient and economical initial preparation or formulation thereof, as well as for the purposes of economical transport, or distibution and/or marketing operations, and can then be subsequently diluted (e.g., by the final distributor or the ultimate user) with water prior to its ultimate use for hard surface cleaning purposes.

In their aforementioned concentrated form, the compositions of the present invention will typically comprise, on a total concentrate composition weight basis:

a. from about 5 to about 50 (preferably from about 5 to about 30) weight percent of the aforementioned glycoside surfactant;

b. from about 2.5 to about 50 (preferably from about 2.5 to about 30) weight percent of the amine oxide surfactant;

c. from about 0.5 to about 25 (preferably from about 0.5 to about 20 and most preferably about 0.5 to about 15) weight percent of the quaternary ammonium halide surfactant;

d. from about 10 to about 50 (preferably from about 10 to about 30) weight percent of the water soluble detergent builder; and e. from about 10 to about 80 (preferably from about 10 to about 65 and most preferably from about 15 or 20 to about 50 or 60) weight percent water.

The dilutable concentrate compositions of the present invention are particularly beneficial in that they generally exhibit lower viscosity at a given solids content than do comparable compositions prepared using other known nonionic surfactants.

The compositions of the present invention in their diluted for ultimate hard surface cleaning purpose form will typically comprise, on a total diluted composition weight basis:

a. from about 0.05 to about 5 (preferably from about 1 to about 5 and more preferably from about 1 to about 3) weight percent of the glycoside surfactant;

b. from about 0.025 to about 5 (preferably from about 0.5 to about 5 and more preferably from about 0.5 to about 2.5) weight percent of the amine oxide surfactant;

c. from about 0.005 to about 2.5 (preferably from about 0.1 to about 2.5 and more preferably from about 0.1 to about 1.5) weight percent of the quaternary ammonium surfactant;

d. from about 0.1 to about 10 (preferably from about 1 to about 10) weight percent of the water soluble detergent builder; and e. from about 50 to about 99.8 (preferably from about 50 to about 97.4) weight percent water.

In another of its broad aspects, the present invention is also represented by a method for cleaning a soiled hard surface by the application thereto and the subsequent removal therefrom of an effective amount of the hard surface cleaning composition of the instant invention in its above-described diluted and ready-to-use form.

In an especially preferred embodiment of the present invention, the aforementioned amine oxide surfactant is employed in amount corresponding to from about 0.5 to about 0.8 (most preferably from about 0.5 to about 0.7) parts by weight of same per one part by weight of the glycoside surfactant and the indicated quaternary ammonium halide surfactant is employed in an amount ranging from about 0.1 to about 0.4 (preferably from about 0.15 to about 0.3) parts by weight for each part by weight of glycoside surfactant employed therein.

DETAILED DESCRIPTION OF THE INVENTION

Glycoside surfactants suitable for use in the practice of the present invention include those of the formula:

$$RO(R'O)_y(Z)_x \qquad \text{I}$$

wherein R is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, akenylaryl, arylalkenyl, etc.) containing from about 6 to about 30 (preferably from about 8 to about 18 and more preferably from about 9 to about 13) carbon atoms; R′ is a divalent hydrocarbon radical containing from 2 to about 4 carbon atoms such as ethylene, propylene or butylene (most preferably the unit $(R'O)_y$ represents repeating units of ethylene oxide, propylene oxide and/or random or block combinations thereof); y is a number having an average value of from 0 to about 12; Z represents a moiety derived from a reducing saccharide containing 5 or 6 carbon atoms (most preferably a glucose unit); and x is a number having an average value of from 1 to about 10 (most preferably from 1 to about 3).

Glycoside surfactants of the sort mentioned above, and various preferred subgenera thereof, are fully discussed in U.S. Pat. No. 4,483,779 to Llenado et al. (issued Nov. 20, 1984), this discussion and description of which is hereby incorporated by reference.

Nonionic glycoside surfactants of particular interest for use in the practice of the present invention preferably have a hydrophilic-lipophilic balance (HLB) in the range of from about 10 to about 18 and most preferably in the range of from about 12 to about 14.

Amine oxide surfactants suitable for use herein include:

(1) Alkyl di(lower alkyl) amine oxides in which the alkyl group has about 10–20, and preferably 12–16 carbon atoms, and can be straight or branched chain, saturated or unsaturated. The lower alkyl groups include between 1 and 7 carbon atoms. Examples of such tertiary amine oxides useful in the invention include lauryl dimethyl amine oxide, myristyl dimethyl amine oxide, and those in which the alkyl group is a mixture of different chain lengths, such as lauryl/myristyl dimethyl amine oxide, dimethyl cocoamine oxide, dimethyl (hydrogenated tallow) amine oxide, and myristyl/palmityl dimethyl amine oxide.

(2) Alkyl di(hydroxy lower alkyl) amine oxides in which the alkyl group has about 10–20, and preferably 12–16 carbon atoms, and can be straight or branched chain, saturated or unsaturated. Examples are bis(2-hydroxyethyl) cocamine oxide; bis(2-hydroxyethyl) tallowamine oxide; and bis(2-hydroxyethyl) stearylamine oxide.

(3) Alkylamidopropyl di(lower alkyl) amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide.

(4) Alkylmorpholine oxides in which the alkyl group has about 10–20, and preferably 12–16 carbon atoms, and can be straight or branched chain, saturated or unsaturated.

Mixtures of any two or more of the amine oxide surfactants identified above may also be used.

Quaternary ammonium halide surfactants suitable for use herein include those of the formula:

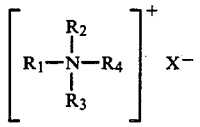

wherein $R_1$, $R_2$, $R_3$, $R_4$ and X can be as hereinafter described. Suitable quaternary ammonium halide surfactants thus include:

(1) Compounds wherein $R_1$ and $R_2$ are lower (i.e., $C_1$–$C_7$) alkyl, and preferably methyl groups; $R_3$ is a benzyl group or a benzyl group substituted with an alkyl group having about 1–18 carbon atoms or an alkyl group having about 8–20, and preferably 8–18, carbon atoms, $R_4$ is a benzyl group or a benzyl group substituted with an alkyl group having about 1–18 carbon atoms or an alkyl group having about 8–20, and preferably 8–18, carbon atoms; and X is a halogen, preferably chlorine. Examples of suitable quaternary ammonium halide surfactants include dioctyl dimethyl ammonium chloride, octyl decyl dimethyl ammonium chloride, didecyl dimethyl ammonium chloride, ($C_{12}$–$C_{18}$) n-alkyl dimethyl benzyl ammonium chloride, ($C_{12}$–$C_{14}$) n-alkyl dimethyl ethylbenzyl ammonium chloride, and dimethyl (difatty) ammonium chloride. In a particularly preferred embodiment of the invention the quaternary ammonium halide surfactant used is a mixture of about (34% by weight $C_{12}$ and 16% by weight $C_{14}$) n-alkyl dimethyl ethylbenzyl ammonium chloride, and about (30% by weight $C_{14}$, 15% by weight $C_{16}$, 2½% by weight $C_{12}$ and 2½% by weight $C_{18}$) n-alkyl dimethyl benzyl ammonium chloride.

(2) Compounds wherein $R_1$, $R_2$ and $R_3$ are lower (i.e., $C_1$–$C_7$) alkyl, and preferably methyl groups; $R_4$ is an alkyl group, an alkyl-substituted benzyl group, or a phenyl-substituted alkyl group having about 8–20, and preferably 8–18 carbon atoms; and X is a halogen, preferably chlorine.

(3) Compounds wherein $R_1$ is an alkyl group, alkyl-substituted benzyl group, or a phenyl-substituted alkyl group having about 10–20, and preferably 12–16 carbon atoms; $R_2$ is lower (i.e., $C_1$–$C_7$) alkyl and preferably a methyl group; $R_3$ is $[—CH_2CH_2O—]_xH$ and $R_4$ is $[—CH_2CH_2O—]_yH$, with the sum of x+y varying between about 2 and 50.

Water soluble detergent builders suitable for use herein include the various water soluble alkali metal, ammonium or substituted ammonium phosphates, polyphosphates, phosphonates, polyphosphonates, carbonates, silicates, borates, polyhydroxysulfonates, polyacetates, carboxylates, and polycarboxylates. Preferred are the alkali metal, especially sodium, salts of the above.

Specific examples of suitable water soluble inorganic phosphate builders are sodium and potassium tripolyphosphate, pyrophosphate, polymeric metaphosphates having a degree of polymerization of from about 6 to 21, and orthophosphate. Examples of polyphosphonate builders are the sodium and potassium salts of ethylene-1,1-diphosphonic acid, the sodium and potassium salts of ethane-1,1,2-triphosphonic acid.

Examples of suitable water soluble nonphosphorus, inorganic builders for use herein include sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

Water soluble, nonphosphorus organic builders useful herein also include the various alkali metal, ammonium and substituted ammonium polyacetates, carboxylates, polycarboxylates and polyhydroxysulfonates.

Examples of polyacetate and polycarboxylate builders are the sodium, potassium, lithium, ammonium and substituted ammonium salts of ethylenediamine tetraacetic acid, nitrilotriacetic acid, oxydisuccinic acid, mellitic acid, benzene polycarboxylic acids, and citric acid.

Polycarboxylate builders suitable for use herein also include those set forth in U.S. Pat. No. 3,308,067, Diehl, issued Mar. 7, 1967 incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Other builders include the carboxylated carbohydrates of U.S. Pat. No. 3,723,322, Diehl, incorporated herein by reference.

Other useful builders herein are sodium and potassium carboxymethyloxymalonate, carboxymethyloxysuccinate, cis-cyclohexanehexacarboxylate, cis-cyclopentanetetracarboxylate, phloroglucinol trisulfonate, water-soluble polyacrylates (having molecular weights of from about 2,000 to about 200,000 for example), and the copolymers of maleic anhydride with vinyl methyl ether or ethylene.

Other suitable polycarboxylates for use herein are the polyacetal carboxylates described in U.S. Pat. No. 4,144,226, issued Mar. 13, 1979 to Crutchfield et al, and U.S. Pat. No. 4,146,495, issued Mar. 27, 1979 to Crutchfield et al, both incorporated herein by reference.

The indicated water soluble builders are preferably employed in the present invention in an amount corresponding to at least about 0.5 (more preferably at least about 1) part thereof by weight per part of combined weight of the indicated glycoside, amine oxide and quaternary ammonium halide surfactants.

The liquid hard surface cleaning compositions of the present invention can, if desired in a given instance, optionally include, typically in relatively minor proportions, one or more of the various known types of supplemental ingredients or additives such as, for example, hydrotropes (e.g., water soluble salts of low molecular weight organic acids such as the sodium or potassium salts of toluene-, benzene-, xylene, or cumene sulfonic acid, sodium or potassium sulfosuccinate, etc.); perfumes; dyes or colorants; thickeners and/or soil suspensing agents (e.g. carboxymethyl cellulose, sodium polyacrylate, polyethylene glycols having molecular weights of from about 400 to about 100,000); deodorizers; ammonia; germicides; antioxidants; aerosol propellants; and the like.

In the preparation of the liquid hard surface cleaning compositions of the present invention, there is generally no particular criticality associated with the order of ingredient addition or the technique employed in manufacturing or formulating same and such can therefore be accomplished in any fashion that may be convenient or expedient under the circumstances to provide the subject composition of interest in the form of a stable, homogeneous aqueous solution thereof.

As has been noted above, the hard surface cleaning compositions of the present invention, if desired, can suitably be initially formulated, transported, distributed and/or marketed in the form of a dilutable aqueous concentrate composition and, in such, event can be diluted to the ultimately desired, end-use active ingredient strength by the eventual end-user or by a distributor at the retail or wholesale level. Alternatively, the liquid hard surface cleaning compositions hereof can also suitably be initially and directly manufactured or formulated, transported, marketed and used or consumed in pre-diluted, ready-to-use form as previously described in accordance with the present invention.

The above-described hard surface cleaning compositions provide efficient and effective cleaning of soiled hard surfaces such as, for example, glass, painted walls, stove tops, woodwork, ceramic tile, appliance housings, and the like.

In evaluating the relative cleaning effectiveness of the subject cleaning compositions, it is convenient to employ a Gardner Washability Apparatus, using a standard soil tile and at standard pressure and sponge stroke settings, to determine or quantify the cleaning efficiency of a given cleaning composition of interest. In determining the cleaning efficiency reflectance values are determined using a Gardner Lab Scan Reflectometer for each of the following: a clean unsoiled panel, a soiled panel and a soiled panel following Gardner Washability Apparatus scrubbing. Such reflectance values are then employed to calculate % cleaning efficiency according to the following formula:

$$\% \text{ cleaning efficiency} = \frac{Rw - Rs}{Ro - Rs} \times 100\%$$

wherein:

Rw=Reflectance of the washed tile or panel

Rs=Reflectance of the soiled tile or panel and Ro=Reflectance of the clean, unsoiled tile or panel.

The cleaning capability of the subject compositions can also be evaluated or characterized in terms their ability to emulsify oily substances such as used motor oil, olive oil, and the like. Evaluation of the oil emulsifying capability of a given cleaning composition can be conveniently accomplished by diluting the cleaning composition of interest (in its pre-diluted, ready-to-use form) with 20 parts by weight of water for each part by weight of said cleaning composition; by placing about 4 fluid ounces of the resulting diluted composition into a container along with about 1 gram of the oily substance of interest; and by stirring the resulting mixture by hand for about 30 seconds. Upon completion of the foregoing procedure, the resulting agitated mixture is rated as to the emulsifying capability of the cleaning composition employed therein according to the following rating schedule:

4=stable emulsion;
3=partially stable emulsion;
2=slight emulsion; and
1=no emulsion.

The present invention is further illustrated and understood by reference to the following example thereof in which all parts and percentages are on a weight basis unless otherwise indicated.

EXAMPLE

In this example, a hard surface cleaning composition is prepared in accordance with the present invention and corresponding to the following recipe:

TABLE I

| Ingredient | Amount (Parts by weight) |
|---|---|
| Glycoside Surfactant[1] | 1.69 |
| Amine Oxide Surfactant[2] | 0.95 |
| Quaternary Ammonium Halide Surfactant[3] | 0.38 |
| Water Soluble Detergent Builder[4] | 3.84 |
| Water | 93.14 |
| Total | 100.00 |

[1]Glycoside surfactant in accordance with Formula I above in which R is a $C_{12}$–$C_{13}$ alkyl group, y is zero, Z is a glucose unit, and x has an average value of about 3.0.
[2]Amine Oxide Surfactant = Lauryl dimethyl amine oxide.
[3]Quaternary Ammonium Halide Surfactant = Mixture of:
(a) Alkyl ($C_{14}$ = 50%, $C_{12}$ = 40%, $C_{16}$ = 10%) dimethyl benzyl ammonium chloride = 20.0%
(b) Octyl decyl dimethyl ammonium chloride = 15.0%
(c) Dioctyl dimethyl ammonium chloride = 7.5%
(d) Didecyl dimethyl ammonium chloride = 7.5%
(e) Water = 50.0%
[4]Water Soluble Builder is a 2:1 weight ratio mixture of sodium metasilicate ($5H_2O$) and sodium tripolyphosphate.

Several alternative compositions (not in accordance with the present invention) are also prepared for comparative purposes. (See Table II below).

The resulting compositions are evaluated as to their cleaning efficiency and/or their emulsifying ability relative to used motor oil and/or olive oil in accordance with the procedures described hereinabove. The results of such evaluations are summarized in Table II below.

TABLE II

| | Example 1 | Control 1 | Control 2 | Control 3 | Control 4 | Control 5 | Control 6 | Control 7 |
|---|---|---|---|---|---|---|---|---|
| Ingredients | | | | | | | | |
| Glycoside Surfactant[1] | 1.69 | 1.69 | 1.69 | 0 | 0 | 3.02 | 0 | 0 |
| Amine Oxide Surfactant[2] | 0.95 | 1.33 | 0 | 2.64 | 0.95 | 0 | 3.02 | 0 |
| Quaternary Ammonium Halide Surfactant[3] | 0.38 | 0 | 1.33 | 0.38 | 2.07 | 0 | 0 | 3.02 |

TABLE II-continued

| | Example 1 | Control 1 | Control 2 | Control 3 | Control 4 | Control 5 | Control 6 | Control 7 |
|---|---|---|---|---|---|---|---|---|
| Ingredients | | | | | | | | |
| Water Soluble Detergent Builder[4] | 3.84 | 3.84 | 3.84 | 3.84 | 3.84 | 3.84 | 3.84 | 3.84 |
| Water | 93.14 | 93.14 | 93.14 | 93.14 | 93.14 | 93.14 | 93.14 | 93.14 |
| Emulsifying Performance[6] | | | | | | | | |
| Used Crankcase Oil | 4 | 3 | 1 | 3 | 2 | 2 | 3 | 1 |
| Olive Oil | 4 | 4 | N.D.[5] | 4 | N.D. | N.D. | N.D. | N.D. |
| % Cleaning Efficiency[6] | 61.4% | 59.8% | N.D.[5] | 58.9% | N.D. | N.D. | 58% | N.D. |

[1-4]See footnotes 1 through 4 in Table I above.
[5]N.D. = No Data.
[6]Compositions identified in Table II are diluted 1 part composition to 20 parts water prior to oil emulsification and cleaning efficiency testing.

As can be seen from the results in Table II, the composition of Example 1 exhibits better used motor oil emulsifying capability than does any of the various comparative compositions.

For further comparative purposes, oil emulsifying capability testing and/or cleaning efficiency testing as set forth above is conducted on an aqueous ethylene glycol monobutyl ether-based detergent formulation corresponding to that indicated in Table III below (Control 8) and on two commercially available, national brand-name liquid hard surface cleaning products (Controls 9 and 10).

TABLE III

CONTROL 8 COMPOSITION

| Ingredient | Amount (weight %) |
|---|---|
| Sodium carbonate | 0.5% |
| Sodium tripolyphosphate | 0.2% |
| Ethylene glycol monobutyl ether | 5.0% |
| Ethoxylated octylphenol (1 mole octylphenol:10 moles ethylene oxide) | 0.5% |
| Water | 93.8% |
| TOTAL | 100.0% |

The cleaning efficiency of the Control 8 formulation is 54.1%.

The Control 9 commercial cleaning composition also has a cleaning efficiency of 54.1% and exhibits a used crankcase oil emulsification rating of 1 and an olive oil emulsification rating of 2.5.

The Control 10 commercial cleaning composition achieves a cleaning efficiency of 55.6%; a used crankcase oil emulsification rating of 2; and an olive oil emulsification rating of 4.

From the foregoing, it is seen that the liquid detergent composition of Example 1 offers superior cleaning performance relative to that provided by the compositions of Controls 8, 9 and 10.

While the present invention has been described and illustrated by reference to certain specific embodiments and examples thereof, such is not to be interpreted as in any way limiting the scope of the instantly claimed invention.

What is claimed is:

1. A liquid detergent composition comprising, on a total weight basis:

(a) from about 0.05 to about 50 weight percent of a glycoside surfactant of the formula:

$$RO(R'O)_y(Z)_x \qquad \text{I}$$

wherein R is a monovalent organic radical containing from about 6 to about 30 carbon atoms; R' is a divalent hydrocarbon radical containing from 2 to about 4 carbon atoms; y is a number having an average value of from 0 to about 12; Z is a moiety derived from a reducing saccharide containing 5 or 6 carbon atoms; and x is a number having an average value of from 1 to about 10;

(b) from about 0.025 to about 50 weight percent of an amine oxide surfactant, said amine oxide surfactant being employed in an amount corresponding to at least about 0.5 parts thereof by weight per part by weight of said glycoside surfactant;

(c) from about 0.005 to about 25 weight percent of a quaternary ammonium halide surfactant, said quaternary ammonium halide surfactant being employed in an amount corresponding to less than about 0.5 parts thereof by weight per part by weight of said glycoside surfactant;

(d) from about 0.1 to about 50 weight percent of a water soluble detergent builder; and (e) from about 10 to about 99.8 weight percent water.

2. The liquid detergent composition of claim 1 in the form of a dilutable liquid concentrate which comprises, on a total weight basis:

(a) from about 5 to about 50 weight percent of the glycoside surfactant;

(b) from about 2.5 to about 50 weight percent of the amine oxide surfactant;

(c) from about 0.5 to about 25 weight percent of the quaternary ammonium halide surfactant;

(d) from about 10 to about 50 weight percent of the water soluble detergent builder; and (e) from about 10 to about 80 weight percent water.

3. The dilutable liquid detergent concentrate composition of claim 2 which comprises, on a total weight basis;

(a) from about 5 to about 30 weight percent of the glycoside surfactant;

(b) from about 2.5 to about 30 weight percent of the amine oxide surfactant;

(c) from about 0.5 to about 15 weight percent of the quaternary ammonium halide surfactant;

(d) from about 10 to about 30 weight percent of the water soluble detergent builder; and (e) from about 10 to about 65 weight percent water.

4. The liquid detergent composition of claim 1 in the form of a diluted hard surface cleaner which comprises, on a total weight basis:

(a) from about 0.05 to about 5 weight percent of the glycoside surfactant;

(b) from about 0.025 to about 5 weight percent of the amine oxide surfactant;

(c) from about 0.005 to about 2.5 weight percent of the quaternary ammonium halide surfactant;

(d) from about 0.1 to about 10 weight percent of the water soluble detergent builder; and (e) from about 50 to about 99.8 weight percent of water.

5. The composition of claim 1 wherein, in the glycoside surfactant of the Formula I, R is an alkyl group containing from about 9 to about 13 carbon atoms; y is zero; Z is derived from glucose; and x has an average value of from 1 to about 3.

6. The composition of claim 1 wherein the weight ratio of glycoside surfactant to amine oxide surfactant is from about 1:0.5 to about 1:0.8 and the weight ratio of glycoside surfactant to quaternary ammonium halide surfactant is from about 1:0.1 to about 1:0.4.

7. The composition of claim 1 wherein the weight ratio of glycoside surfactant to amine oxide surfactant is from about 1:0.5 to about 1:0.7 and the weight ratio of glycoside surfactant to quaternary ammonium halide surfactant is from about 1:0.15 to about 1:0.3.

8. The composition of claim 2 wherein the weight ratio of glycoside surfactant to amine oxide surfactant is from about 1:0.5 to about 1:0.8 and the weight ratio of glycoside surfactant to quaternary ammonium halide surfactant is from about 1:0.1 to about 1:0.4.

9. The composition of claim 2 wherein the weight ratio of glycoside surfactant to amine oxide surfactant is from about 1:0.5 to about 1:0.7 and the weight ratio of glycoside surfactant to quaternary ammonium halide surfactant is from about 1:0.15 to about 1:0.3.

10. The composition of claim 4 wherein the weight ratio of glycoside surfactant to amine oxide surfactant is from about 1:0.5 to about 1:0.8 and the weight ratio of glycoside surfactant to quaternary ammonium halide surfactant is from about 1:0.1 to about 1:0.4.

11. The composition of claim 4 wherein the weight ratio of glycoside surfactant to amine oxide surfactant is from about 1:0.5 to about 1:0.7 and the weight ratio of glycoside surfactant to quaternary ammonium halide surfactant is from about 1:0.15 to about 1:0.3.

12. The composition of claim 1 wherein the amine oxide surfactant is selected from the group consisting of alkyl di(lower alkyl)amine oxides, alkyl di(hydroxy lower alkyl)amine oxides, alkylamido-propyl di(lower alkyl)amine oxides, and alkylmorpholine oxides in which the "alkyl" group contains from about 10 to 20 carbon atoms and in which the "lower alkyl" groups contains from 1 to 7 carbon atoms.

13. The composition of claim 12 wherein the quaternary ammonium halide surfactant corresponds to the formula:

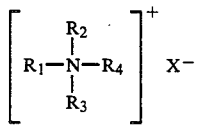

wherein X is a halogen and wherein:

(i) $R_1$ and $R_2$ are $C_1$–$C_7$ alkyl groups and $R_3$ and $R_4$, individually, is a benzyl group or a benzyl group bearing a $C_1$–$C_{18}$ alkyl substituent or an alkyl group of from about 8 to 20 carbon atoms;

(ii) $R_1$, $R_2$ and $R_3$ are each $C_1$–$C_7$ alkyl groups and $R_4$ is an alkyl, alkyl-substituted benzyl or a phenyl-substituted alkyl group containing about 8 to 20 carbon atoms; or (iii) $R_1$ is an alkyl, alkyl-substituted benzyl or a phenyl-substituted alkyl group containing about 10 to 20 carbon atoms, $R_2$ is a $C_1$–$C_7$ alkyl group, $R_3$ is $[—CH_2CH_2—O]_xH$ and $R_4$ is $[—CH_2CH_2—O]_yH$ wherein the sum of x and y is between about 2 and 50.

14. The composition of claim 13 wherein the water soluble detergent builder is selected from the group consisting of alkali metal, ammonium or substituted ammonium phosphates, polyphosphates, phosphonates, polyphosphonates, carbonates, silicates, borates, polyhydroxysulfonates, polyacetates, carboxylates and polycarboxylates.

15. A method for cleaning a soiled hard surface which comprises applying thereto and subsequently removing therefrom a liquid detergent composition comprising, on a total weight basis;

(a) from about 0.05 to about 5 weight percent of a glycoside surfactant of the formula:

$$RO(R'O)_y(Z)_x \qquad \text{I}$$

wherein R is a monovalent organic radical containing from about 6 to about 30 carbon atoms; R' is a divalent hydrogen radical containing from 2 to about 4 carbon atoms; y is a number having an average value of from 0 to about 12; Z is a moiety derived from a reducing saccharide containing 5 or 6 carbon atoms; and x is a number having an average value of from 1 to about 10;

(b) from about 0.025 to about 5 weight percent of an amine oxide surfactant, said amine oxide surfactant being employed in an amount corresponding to at least about 0.5 parts thereof by weight per part by weight of said glycoside surfactant;

(c) from about 0.005 to about 2.5 weight percent of a quaternary ammonium halide surfactant, said quaternary ammonium halide surfactant being employed in an amount corresponding to less than about 0.5 part thereof by weight per part by weight of said glycoside surfactant;

(d) from about 0.1 to about 10 weight percent of a water soluble detergent builder; and (e) from about 50 to about 99.8 weight percent water.

16. The method of claim 15 wherein the weight ratio of glycoside surfactant to amine oxide surfactant is from about 1:0.5 to about 1:0.8 and the weight ratio of glycoside surfactant to quaternary ammonium halide surfactant is from about 1:0.1 to about 1:0.4.

17. The method of claim 15 wherein the weight ratio of glycoside surfactant to amine oxide surfactant is from about 1:0.5 to about 1:0.7 and the weight ratio of glycoside surfactant to quaternary ammonium halide surfactant is from about 1:0.15 to about 1:0.3.

18. The method of claim 15 wherein the amine oxide surfactant is selected from the group consisting of alkyl di(lower alkyl)amine oxides, alkyl di(hydroxy lower alkyl)amine oxides, alkylamido-propyl di(lower alkyl)amine oxides, and alkylmorpholine oxides in which the "alkyl" group contains from about 10 to 20 carbon atoms and in which the "lower alkyl" group contains from 1 to 7 carbon atoms.

19. The method of claim 18 wherein the quaternary ammonium halide surfactant corresponds to the formula:

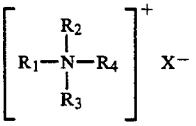

wherein X is a halogen and wherein:

(i) $R_1$ and $R_2$ are $C_1$–$C_7$ alkyl groups and $R_3$ and $R_4$, individually, is a benzyl group or a benzyl group bearing a $C_1$–$C_{18}$ alkyl substituent or an alkyl group of from about 8 to 20 carbon atoms;

(ii) $R_1$, $R_2$ and $R_3$ are each $C_1$–$C_7$ alkyl groups and $R_4$ is an alkyl, alkyl-substituted benzyl or a phenyl-substituted alkyl group containing about 8 to 20 carbon atoms; or (iii) $R_1$ is an alkyl, alkyl-substituted benzyl or a phenyl-substituted alkyl group containing about 10 to 20 carbon atoms, $R_2$ is a $C_1$–$C_7$ alkyl group, $R_3$ is $[—CH_2CH_2—O]_xH$ and $R_4$ is $[—CH_2CH_2—O]_yH$ wherein the sum of x and y is between about 2 and 50.

20. The method of claim 19 wherein the water soluble detergent builder is selected from the group consisting of alkali metal, ammonium or substituted ammonium phosphates, polyphosphates, phosphonates, polyphosphonates, carbonates, silicates, borates, polyhydroxysulfonates, polyacetates, carboxylates and polycarboxylates.

* * * * *